United States Patent [19]

Pozzobon

[11] Patent Number: 5,003,710

[45] Date of Patent: Apr. 2, 1991

[54] SKI BOOT

[75] Inventor: Alessandro Pozzobon, Paderno Di Ponzano Veneto, Italy

[73] Assignee: Nordica S.p.A., Montebelluna, Italy

[21] Appl. No.: 519,584

[22] Filed: May 7, 1990

[30] Foreign Application Priority Data

May 22, 1989 [IT] Italy ..... 82544 A/89

[51] Int. Cl.[5] ..... A43B 5/04

[52] U.S. Cl. ..... 36/117; 36/120

[58] Field of Search ..... 36/117-121

[56] References Cited

U.S. PATENT DOCUMENTS

| | | | |
|---|---|---|---|
| 4,461,103 | 7/1984 | Annpui | 36/117 X |
| 4,624,063 | 11/1986 | Delery | 36/117 |
| 4,654,985 | 4/1987 | Chalmers | 36/115 X |
| 4,825,566 | 5/1989 | Sartor | 36/117 |

*Primary Examiner*—Paul T. Sewell
*Assistant Examiner*—Ted Kavanaugh
*Attorney, Agent, or Firm*—Guido Modiano; Albert Josif

[57] ABSTRACT

A ski boot includes a shell, a front quarter and a rear quarter, the shell may be made in one piece or by overlapping flaps, the front quarter includes a first element and a second element, the first element has at least one flap overlapping the second element; fastening means being provided to close said front quarter onto the rear quarter.

11 Claims, 4 Drawing Sheets

1
2
3
4
5
6
7
8
9
10
11
12
13
14
15
16
17
18
19

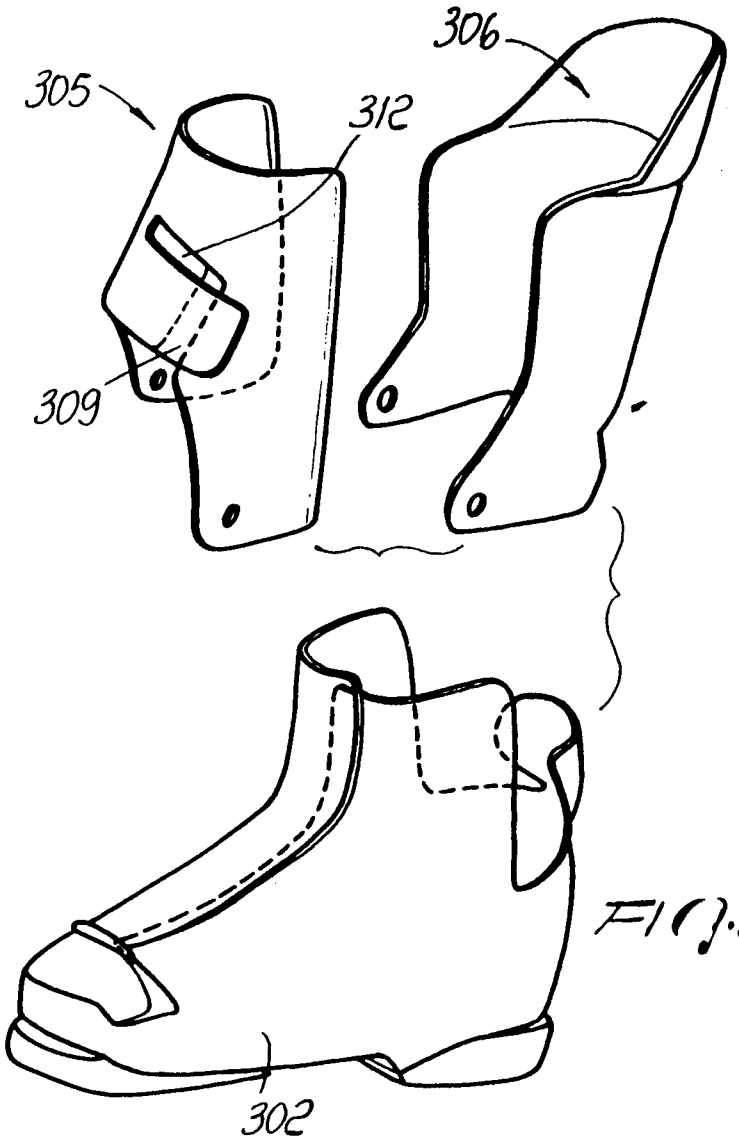
Fig. 9
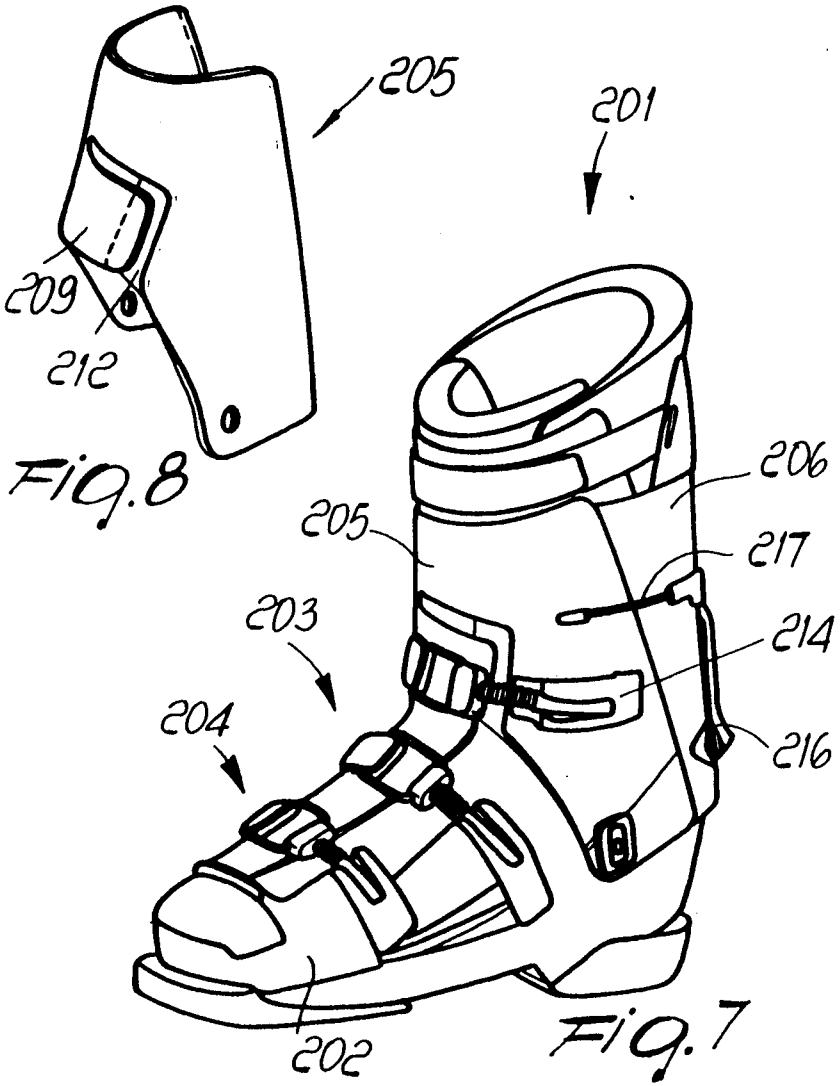
Fig. 8
Fig. 7

SKI BOOT

BACKGROUND OF THE INVENTION

The present invention relates to a ski boot.

The known ski boots are substantially of three types: a rear-entry ski boot constituted by a rigid monolithic shell with which a front quarter and a rear quarter (which can be tilted down to allow the insertion of the foot from the rear) are associated; a second rear-entry ski boot constituted by a shell with overlapping flaps with which a single quarter is associated and has front flaps which can partially overlap and interact with closure means such as levers; and a third mixed-structure boot which comprises a shell with overlapping flaps with which a front quarter and a rear quarter are associated.

This last type is nowadays the most interesting, since it is an attempt to combine the advantages of the front entry type in which the foot is better embraced, with those of the rear entry type, which gives a better comfort; the known boots of this third type still have to be developed significantly though.

A ski boot is known, for example, which is constituted by a lower portion and by a quarter which is articulated on said lower part in two opposite points lying at the axis of articulation of the foot; the rear part of the quarter has a rounded hollow portion which allows extensive downward tilting. Said hollow portion is preferably covered by a cap connected to the quarter by means of a rigid coupling element.

This known type of ski boot has the important disadvantage of being composed of a large number of components which are also structurally complex; the industrial production of such a ski boot is therefore extremely difficult and the overall manufacturing costs are very high.

SUMMARY OF THE INVENTION

The aim of the present invention is therefore to eliminate the disadvantages described above in known types by providing a ski boot which optimally secures the foot which at the same time can be easily inserted from the rear.

Within the scope of the above aim, an important object is to provide a ski boot composed of a very small number of component parts and that can be easily manufactured at lower costs.

Not least object is to provide a ski boot which associates with the preceding characteristics that of being reliable and safe in use.

The above mentioned aim and objects, as well as others which will become apparent hereinafter, are achieved by a ski boot comprising a shell, a front quarter and a rear quarter, said rear quarter and said front quarter being articulated to said shell, characterized in that said front quarter comprises at least a first element and a second element, said first element at least partially overlapping said second element, each of said first element and second element having a lower portion connected to said shell and an upper portion, at least one of said first and second elements having at least one flap at said upper portions, fastening means being provided at said upper portions for fastening said front quarter onto said rear quarter.

Advantageously, said one or more elements are possibly mutually associable in a temporary or permanent manner.

BRIEF DESCRIPTION OF THE DRAWINGS

Further characteristics and advantages of the invention will become apparent from the detailed description of some particular but not exclusive embodiments, illustrated only by way of non-limitative example in the accompanying drawings, wherein:

FIG. 7 is a view, similar to that of FIG. 1, of a third embodiment of the ski boot;

FIG. 8 shows the front quarter of the ski boot of FIG. 7;

FIG. 9 is an exploded isometric side view of a fourth embodiment;

DESCRIPTION OF THE PREFERRED EMBODIMENTS

Figures 1, 2, 3, 4:
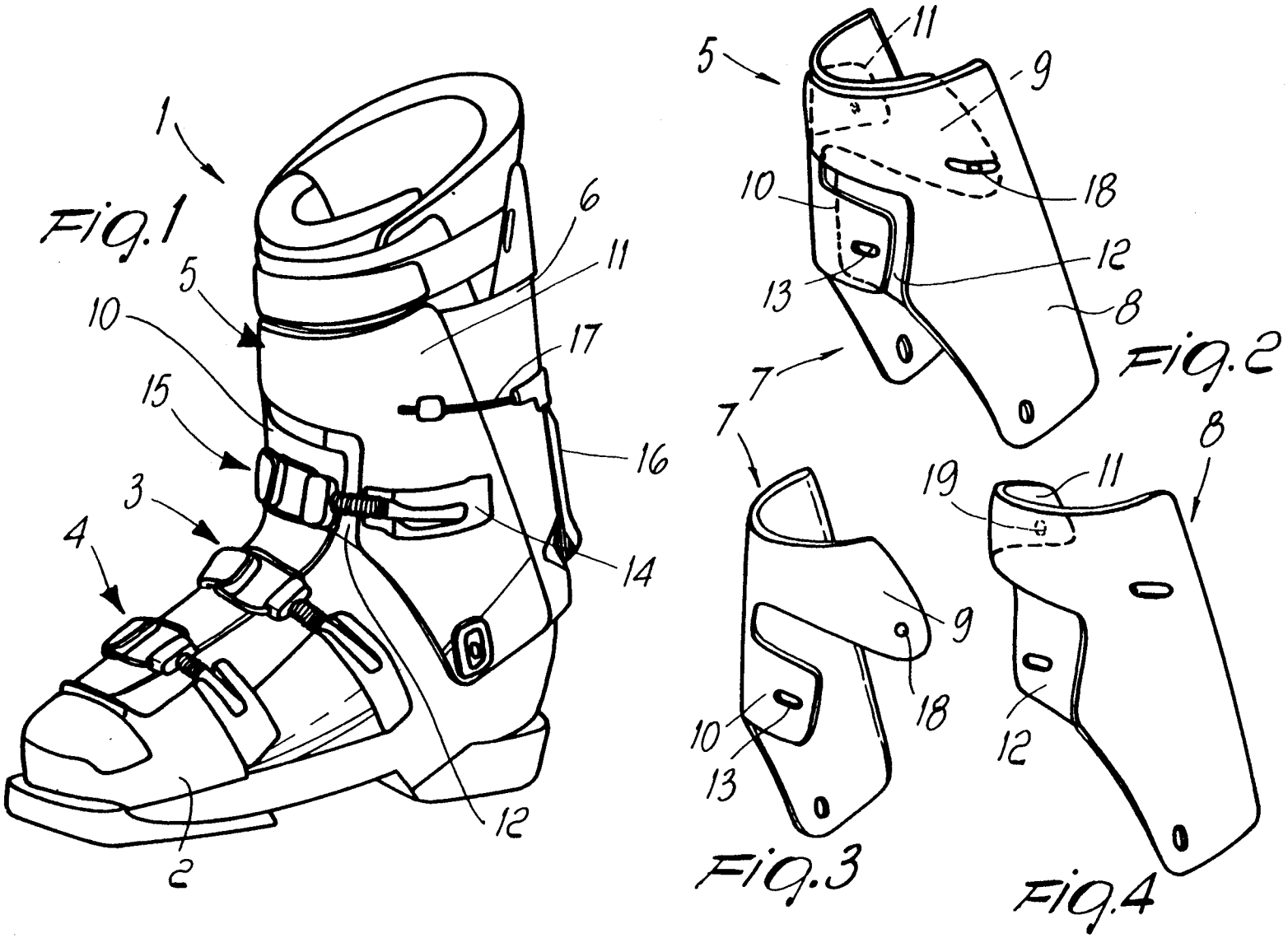
FIG. 1 is an isometric side view of a first embodiment of the ski boot, according to the invention.
FIG. 2 is an isometric side view of the front quarter of the boot of FIG. 1.
FIGS. 3 and 4 respectively illustrate the individual elements which constitute the front quarter of FIG. 2.

With reference to the above figures, the ski boot, generally indicated by the reference numeral 1, comprises a shell 2, which may be integral or constituted by overlapping flaps, and has a fastening means at the region 3 of the foot instep and/or a second fastening means at the metatarsal region 4. The fastening means may be, for example, adapted levers of a known type arranged across the shell, or, in the case of an integral shell, they may be pressers and/or cables of a per se known type.

The ski boot furthermore comprises a front quarter 5 and a rear quarter 6 which are associated with the shell 2.

The front quarter comprises a first element 7 and a second element 8, each of which is associated, at one end, with the shell 2 as previously described; the first element 7 has a lower portion associated with the shell and an upper portion; at its upper portion the first element has a first flap 9 and a second flap 10 which is arranged parallel to the first one and extends toward the second element 8 so as to affect the entire front region of the boot; the first flap 9, also partially affect the lateral region corresponding to the outer malleoli.

The second element 8 also has a lower portion associated with the shell and an upper portion; at its upper portion the second element has a third flap 11 which affects the front and partially lateral region of the boot at the portion from which the inner malleolus of the foot protrudes.

Said third flap 11 is superimposed, once the boot is closed, on the first flap 9 of the first element 7, whereas the second flap 10 of said first element is partially superimposed and slidable at a depressed portion 12 which extends below said third flap 11 of the second element 8 toward the front region of the structure of boot.

The depressed portion 12 partially extends at the region which lies under the terminal end of said second flap 10.

The terminal end of the second flap 10 may have one or more adapted first holes or slots 13 for coupling to the depressed portion 12.

A fastening means, such as a hook-shaped lever 14 arranged across the boot at the tibial, or front, region 15 adjacent to the foot instep region 3, is provided at the second flap 10 and the second element 8; said hook-like lever connects said second flap 10 to said second element 8.

An adapted fastening means 16 is advantageously provided, in order to close the front quarter 5 onto the rear quarter 6, at the rear quarter 6. The fastening means may be adapted to wind one or more traction elements, such as cables 17, the ends whereof are associated at adapted second holes 18 and third holes 19 provided at the ends of the first flap 9 and of the third flap 11 respectively.

One or more slots for the passage of the cables are advantageously provided on the second element 8 for coupling at the second holes 18.

The ski boot thus obtained provides the closure of at least three regions (metatarsal region, foot instep region and lower tibial/ankle region) typical of the kind of boot known as front-entry type boots, and at the same time provides an easy entry from the rear because the rear quarter 6 can be tilted backward being it associated laterally with the shell 2.

The ski boot thus obtained has a very small number of components and can be manufactured in a very simple manner, from a production point of view.

Furthermore, if the quarter is used on an integral shell, the hook-shaped lever allows to adjust the flexibility, varying the play between the quarter and the shell.

The ski boot according to the invention is naturally susceptible to numerous modifications and variations, all of which are within the scope of the same inventive concept.

Figure 6:
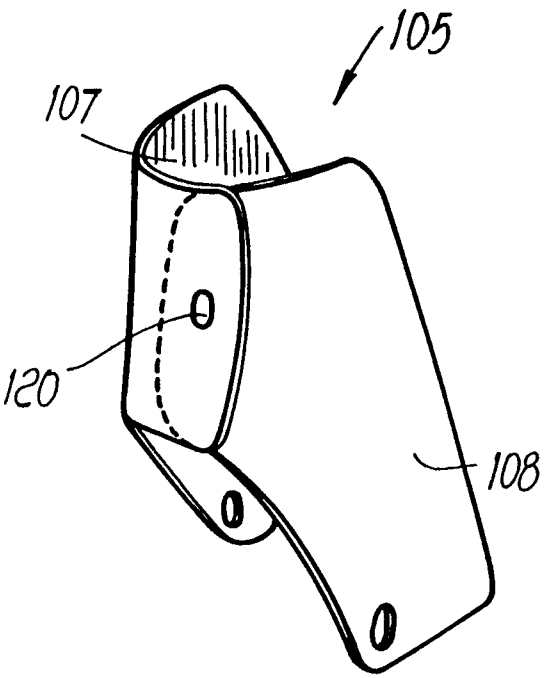
FIG. 6 is a view, similar to that of FIG. 2, of the front quarter according to the second embodiment of the ski boot.
Figure 5:
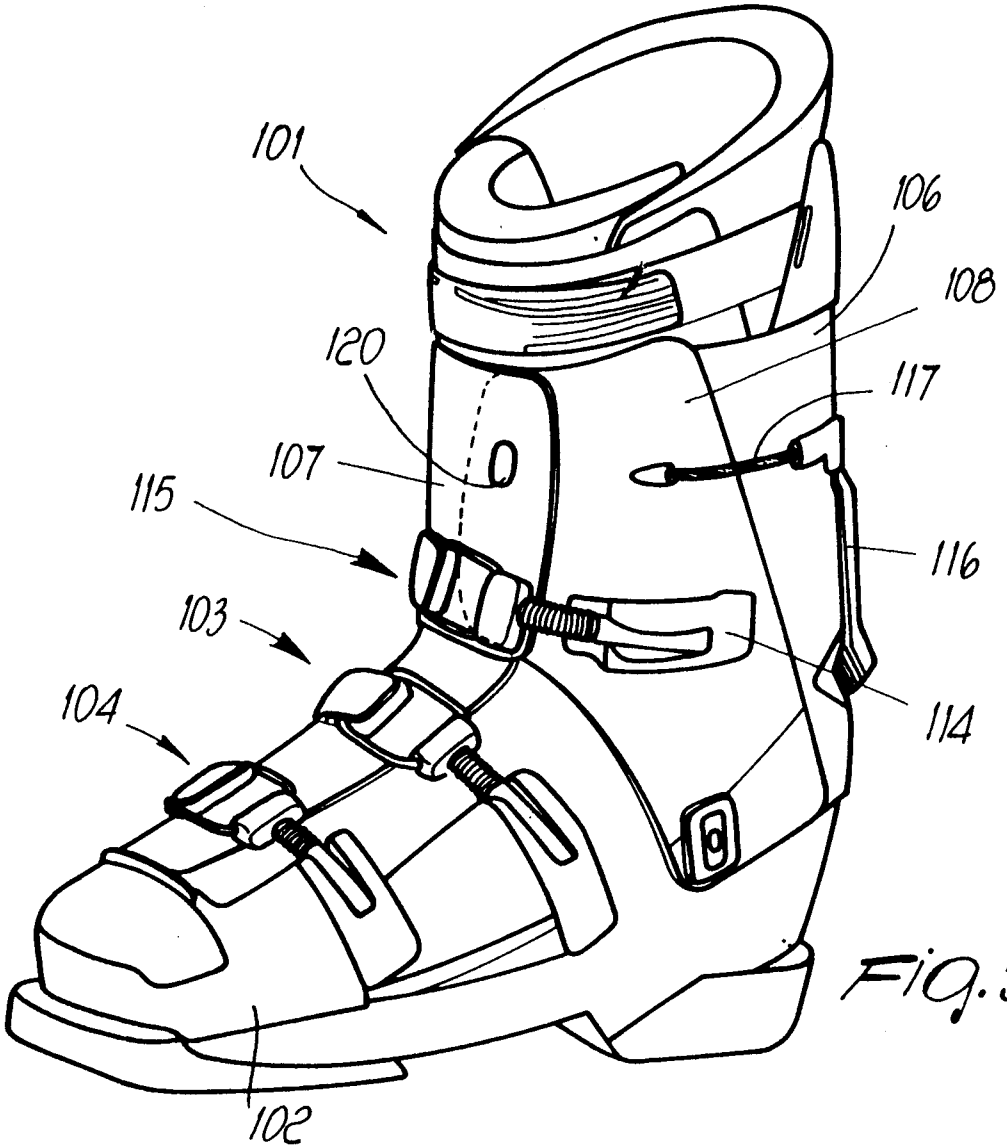
FIG. 5 is a view, similar to that of FIG. 1, of a second embodiment of the ski boot according to the invention.

Thus, for example, FIGS. 5 and 6 illustrate a ski boot 101 in which the front quarter 105 comprises a first element 107 and a second element 108 which are associated, at one end, with a shell 102 of the overlapping-flap type or of the integral type with a fastening means at the instep region 103 and/or at the metatarsal region 104.

Said first and second elements partially overlap one another at the front region of the boot 101 and can be removably connected to one another for example by means of an adapted rivet 120.

A locking device, such as for example a hook-like lever 114 adjacent to the foot instep region 103, can be provided at the tibial region 115 in this embodiment as well.

The closure between the front quarter 105 and the rear quarter 106 is again ensured by means of a fastening means 116 adapted to adjust the tension of traction elements, such as for example cables 117, which are fastened, at their ends, to the sides of said first and second elements.

FIGS. 7 and 8 illustrate a third embodiment of the invention, wherein a ski boot 201 composed of a shell 202 with overlapping flaps or integral, with a fastening means, such as adapted hook-like levers or pressers and/or cables at the instep region 203 and at the metatarsal region 204.

A front quarter 205 and a rear quarter 206 are articulated, at one end, at the sides of the shell 202.

The front quarter 205 has, at the front region, a first flap 209 which is arranged across said quarter and is partially superimposed and slidable, at its free end, at a depressed portion 212 which extends, on the same front quarter 205, again approximately at the front region.

In this case, too, a locking device is associated at the first flap and is constituted for example by a hook-like lever 214 which is fastened, at its other end, to the front quarter 205, which is constituted by a single element.

Adapted fastening means 216, adapted to fasten the quarters, is advantageously associated at the rear quarter 206 and is adapted to tension traction elements, such as for example cables 217 which are coupled, at their ends, to the sides of the front quarter 205.

FIG. 9 illustrates a fourth embodiment of the ski boot which is again constituted by a shell 302, with overlapping flaps or of the integral type, and by a front quarter 305 and a rear quarter 306 associated with the shell 302.

The front quarter 305 is constituted by a single piece which has, approximately at the front region, a first flap 309 which extends across the front quarter 305, and, with its free end, also partially extends at the side of the front quarter 305.

The free end of the first flap 309 is therefore partially superimposed at said front quarter.

Said front quarter furthermore has, at the front region affected by said first flap 309, an underlying depressed portion 312 which partially occludes the space underlying said first flap 309.

The dimensions of the depressed portion 312 are such as to leave in any case a free space below said first flap proximate to its free end.

Figure 10:
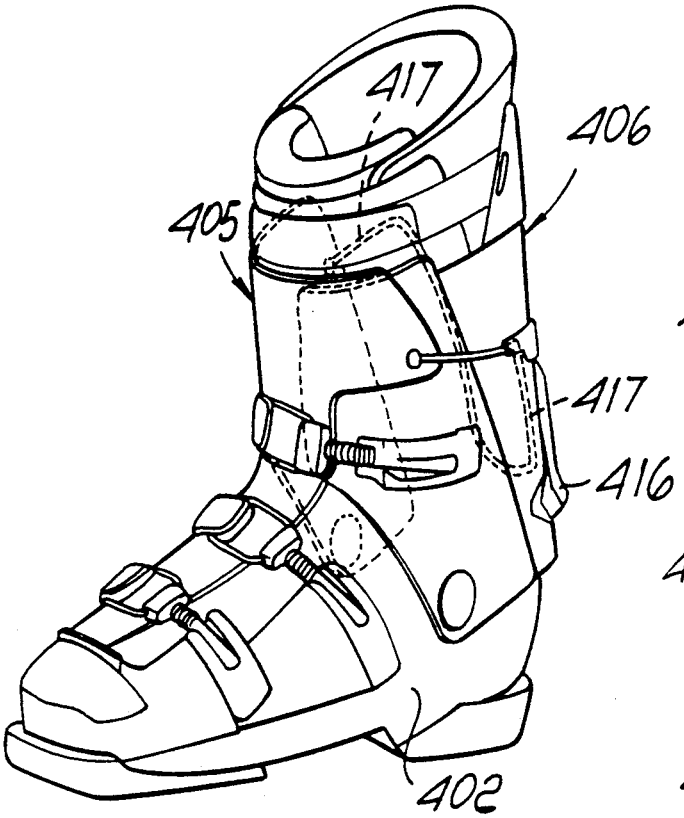
FIG. 10 shows a fifth embodiment of the ski boot.
Figure 11:
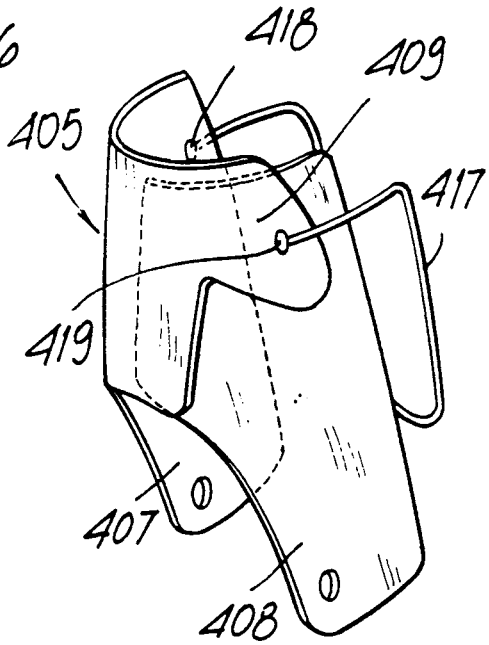
FIG. 11 shows the front quarter of the ski boot of FIG. 10.
Figure 12:
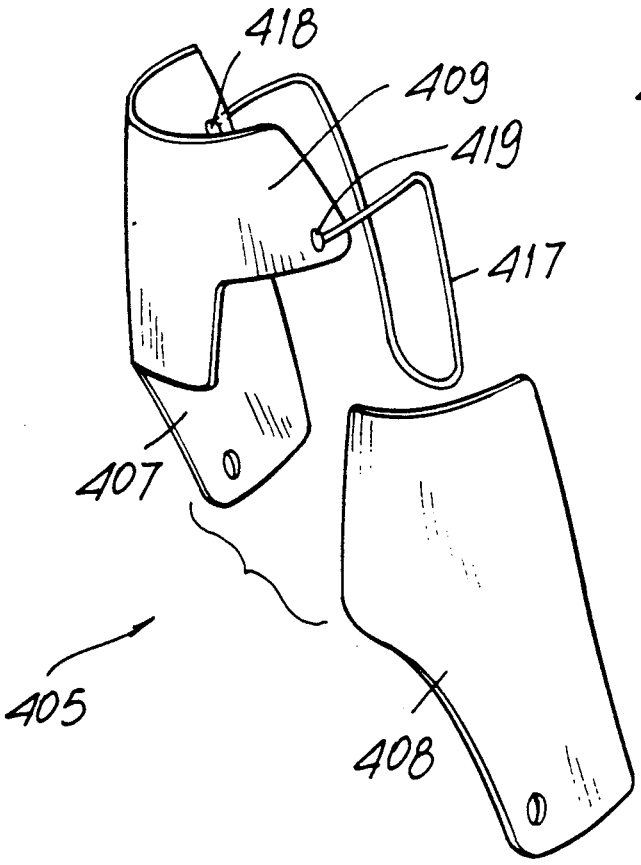
FIG. 12 is an exploded view of the front quarter of FIG. 11.

FIGS. 10–12 show a ski boot 401 according to a fifth embodiment of the invention, and comprising a shell 402, a rear quarter 406 and a front quarter 405.

The front quarter 405 comprises a first element 407 overlapping a second element 408 at the front region of the boot 401.

The first element 407 is furthermore provided with a flap 409 extending on the side of the second element 408.

A traction element, such as a cable 417, is fastened to the first element 407, and in particular a first end 418 of the cable is fastened to a side of the first element 407, and a second end 419 of the cable 417 is fastened to the flap 409.

The cable 417 is preferably associated with a fastening means 416, advantageously provided at the rear quarter 406, as schematically illustrated in FIG. 10.

By tensioning the cable 417, through the fastening device 416, the first element 407 is closed on the second element 408. This simplified design provides an equal fastening strength for both the front quarter elements and a very good enveloping of the leg.

The dimensions and the materials which constitute the individual components of the structure may naturally vary according to the specific requirements.

I claim:

1. Ski boot comprising a shell, a front quarter and a rear quarter, said rear quarter and said front quarter being articulated to said shell, wherein said front quarter comprises at least a first element and a second element, said first element at least partially overlapping said second element, each of said first element and second element having a lower portion connected to said shell and an upper portion, at least one of said first and second elements having at least one flap at said upper portions, fastening means being provided at said upper portions for fastening said front quarter onto said rear quarter.

2. Ski boot according to claim 1, wherein said first element has, at said upper portion, first and second flaps which are arranged parallel to one another along an axis which is transverse to said front quarter at a front region of said boot.

3. Ski boot according to claim 2, wherein said second flap extends toward said second element and affects said entire front region of said boot, said first flap extending toward said second element and partially extending also at a lateral region of said second element, said lateral region lying substantially at the outer malleolar region of the foot.

4. Ski boot according to claim 2, wherein said second flap extends toward said second element and affects said entire front region of said boot, said first flap extending toward said second element and partially extending also at a lateral region of said second element, said lateral region lying substantially at the outer malleolar region of the foot, said second element having, at said upper portion, a third flap extending at said front region and partially at a lateral region of said boot at the region from which the inner malleolus of the foot protrudes, when said quarters are closed, said third flap overlapping said first flap of said first element, whereas said first flap is partially superimposed and slidable at a depressed portion which extends below said third flap of said second element toward said front region.

5. Ski boot according to claim 2, wherein said second flap extends toward said second element and affects said entire front region of said boot, said first flap extending toward said second element and partially extending also at a lateral region of said second element, said lateral region lying substantially at the outer malleolar region of the foot, said second element having, at said upper portion, a third flap extending at said front region and partially at a lateral region of said boot at the region from which the inner malleolus of the foot protrudes, when said quarters are closed, said third flap overlapping said first flap of said first element, whereas said first flap is partially superimposed and slidable at a depressed portion which extends below said third flap of said second element toward said front region, said depressed portion partially extending at a region underlying the terminal end of said second flap, one or more adapted first holes for mutual coupling being provided at said second flap and at said depressed portion.

6. Ski boot according to claim 2, wherein said fastening means comprises a hook-like lever arranged across said boot at said front region adjacent to the foot instep region, and provided between said second flap and said second element, said hook-like lever connecting said second flap to said second element.

7. Ski boot according to claim 2, wherein said second flap extends toward said second element and affects said entire front region of said boot, said first flap extending toward said second element and partially extending also at a lateral region of said second element, said lateral region lying substantially at the outer malleolar region of the foot, said second element having, at said upper portion, a third flap extending at said front region and partially at a lateral region of said boot at the region from which the inner malleolus of the foot protrudes, when said quarters are closed, said third flap overlapping said first flap of said first element, whereas said first flap is partially superimposed and slidable at a depressed portion which extends below said third flap of said second element toward said front region, a fastening device being associated at said rear quarter, said fastening device being adapted to take-up at least one traction element, the ends of said traction element being associated at adapted second and third holes provided at the ends of said first and third flaps respectively.

8. Ski boot according to claim 1, wherein said first element is removably connected to said second element.

9. Ski boot, according to claim 1, wherein said first element and said second element are made integral, said first element having a first flap at least partially extending and sliding over a depressed portion, said depressed portion being formed at said second element.

10. Ski boot according to claim 1, wherein said first element and said second element are made integral, said first element having a first flap at least partially extending and sliding over said second element, at a side of said front quarter 11. Ski boot, according to claim 1, wherein said upper portion of said first element has a first flap, extending over said second element, and a side lying opposite to said second element, said fastening means comprising a cable having a first end and a second end and a fastening device for tensioning said cable, said first end being connected to said side opposite to said second element of said first element, said second element being connected to said first flap of said first element, said fastening device being associated with said rear quarter.

* * * * *